US006367752B1

(12) United States Patent
Forsythe et al.

(10) Patent No.: US 6,367,752 B1
(45) Date of Patent: Apr. 9, 2002

(54) ELECTRONIC PRICE LABEL MOUNTING APPARATUS

(75) Inventors: Donald L. Forsythe, Dacula, GA (US); Syuzoh Kato, Kanagawa (JP); Sik Piu Kwan, Suwanee, GA (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/420,724

(22) Filed: Oct. 20, 1999

(51) Int. Cl.[7] ..... A47B 96/06

(52) U.S. Cl. ..... 248/220.21; 248/225.11; 40/661.03; 40/651

(58) Field of Search ..... 248/220.21, 225.11, 248/228.31, 292.14, 923, 222.11, 316.7, 231.81; 211/86.01, 119.003; 40/642.02, 661.03, 651, 649

(56) References Cited

U.S. PATENT DOCUMENTS

| | | | | | |
|---|---|---|---|---|---|
| 3,084,463 | A | * | 4/1963 | Guyer et al. | 40/564 |
| 4,002,886 | A | | 1/1977 | Sundelin | 235/61.7 R |
| 4,500,880 | A | | 2/1985 | Gomersall et al. | 340/825.35 |
| 4,924,363 | A | | 5/1990 | Kornelson | 362/125 |
| 4,939,861 | A | | 7/1990 | Soubliere | 40/651 |
| 5,044,104 | A | * | 9/1991 | Hopperdietzel | 40/642 |
| 5,172,314 | A | | 12/1992 | Poland et al. | 364/401 |
| 5,288,046 | A | * | 2/1994 | Elkof et al. | 248/220.2 |
| D348,287 | S | | 6/1994 | Odmark | D20/43 |
| 5,348,485 | A | | 9/1994 | Briechle et al. | 439/110 |
| 5,394,632 | A | | 3/1995 | Gebka et al. | 40/642 |
| 5,419,066 | A | * | 5/1995 | Harnois et al. | 40/642 |
| 5,448,226 | A | | 9/1995 | Failing, Jr. et al. | 340/825.35 |
| 5,461,809 | A | | 10/1995 | Fowler et al. | 40/642 |
| 5,473,832 | A | | 12/1995 | Briechle et al. | 40/642 |
| 5,488,793 | A | | 2/1996 | Gebka et al. | 40/642 |
| 5,515,631 | A | | 5/1996 | Gebka et al. | 40/642 |
| D373,146 | S | | 8/1996 | Odmark | D20/43 |
| 5,553,412 | A | | 9/1996 | Briechle et al. | 40/642 |
| 5,611,512 | A | | 3/1997 | Cholet | 248/220.22 |
| D382,305 | S | | 8/1997 | Odmark | D20/43 |
| D386,534 | S | | 11/1997 | Odmark | D20/43 |
| D386,535 | S | | 11/1997 | Odmark | D20/43 |
| 5,715,622 | A | | 2/1998 | Giordano, Jr. | 40/661.03 |
| 5,791,080 | A | * | 8/1998 | Hamano | 40/642.02 |
| 5,794,211 | A | | 8/1998 | Goodwin, III et al. | 705/23 |
| 5,816,550 | A | * | 10/1998 | Watanabe et al. | 248/222.11 |
| 5,899,011 | A | * | 5/1999 | Brinkman | 40/661.03 |
| 5,966,854 | A | * | 10/1999 | Walsh et al. | 40/514 |
| 6,000,611 | A | * | 12/1999 | Dalton et al. | 235/383 |
| 6,035,569 | A | * | 3/2000 | Nagel et al. | 40/661.03 |
| 6,069,596 | A | * | 5/2000 | Marvin et al. | 345/52 |
| 6,105,295 | A | * | 8/2000 | Brinkman et al. | 40/661.03 |
| 6,119,990 | A | * | 9/2000 | Kump et al. | 248/220.22 |
| 6,142,322 | A | * | 11/2000 | Smith et al. | 211/183 |
| 6,189,248 | B1 | * | 2/2001 | Nagel et al. | 40/661.03 |

FOREIGN PATENT DOCUMENTS

GB 2221836 A1 * 2/1990

* cited by examiner

*Primary Examiner*—Anita King
*Assistant Examiner*—Naschica S. Morrison
(74) *Attorney, Agent, or Firm*—Paul W. Martin

(57) ABSTRACT

An electronic price label mounting apparatus which securely retains electronic price label. The electronic price label mounting apparatus includes a frame member defining an aperture through which the electronic price label is inserted, and a top member extending from the frame member which is secured by a fastener to a mounting surface. The top member may be secured to a mounting surface, including a C-channel, wall, or sign.

11 Claims, 4 Drawing Sheets

ELECTRONIC PRICE LABEL MOUNTING APPARATUS

BACKGROUND OF THE INVENTION

The present invention relates to electronic price label (EPL) systems, and more specifically to an electronic price label mounting apparatus.

EPL systems typically include a plurality of EPLs for merchandise items in a transaction establishment. EPLs typically display the price of corresponding merchandise items on store shelves and are typically attached to a rail along the leading edge of the shelves. A transaction establishment may contain thousands of EPLs to display the prices of the merchandise items. The EPLs are coupled to a central server from where information about the EPLs is typically maintained in an EPL data file. Price information displayed by the EPLs is obtained from a price look-up (PLU) data file and stored within an EPL price change record.

EPLs are typically mounted to a C-channel along a shelf edge, either in an attached rail or in the shelf itself. One problem with current shelf mounting methods is that they do not provide adequate security against accidental or unauthorized removal.

Therefore, it would be desirable to provide an EPL mounting apparatus which more securely holds EPLs in place. It would also be desirable for the mounting apparatus to be easy to use by store employees.

SUMMARY OF THE INVENTION

In accordance with the teachings of the present invention, an electronic price label (EPL) mounting apparatus is provided.

The electronic price label mounting apparatus includes a frame member defining an aperture through which the electronic price label is inserted, and a top member extending from the frame member which is secured by a fastener to a mounting surface. The top member may be secured to a mounting surface, including a C-channel, wall, or sign.

In a preferred embodiment, the frame member includes a flange extending from a wall of the frame member and having a second aperture, and a first fastener which retains the electronic price label in the frame member when the electronic price label is in the frame member. The top member includes an inclined portion having a third aperture, and a second fastener which extends through the third aperture to secure the top member in a C-channel when the electronic price label mounting apparatus is in the C-channel. The mounting apparatus additionally includes a number of wall portions extending between the top member and the frame member, including an indent portion which helps to secure the wall portions to the C-channel.

The top member of the preferred embodiment may additionally include a back portion having a fourth aperture for mounting the electronic price label to a mounting surface instead of a C-channel.

It is accordingly an object of the present invention to provide an EPL mounting apparatus.

It is another object of the present invention to provide an EPL mounting apparatus which securely retains an EPL.

It is another object of the present invention to provide an EPL mounting apparatus which fits within C-channels of most types of shelves available today.

It is another object of the present invention to provide an EPL mounting apparatus for various shelf heights.

It is another object of the present invention to provide an EPL mounting apparatus which includes a bib retainer.

It is another object of the present invention to provide an EPL mounting apparatus which is versatile in design, being able to mount EPLs to locations other than shelf C-channels.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
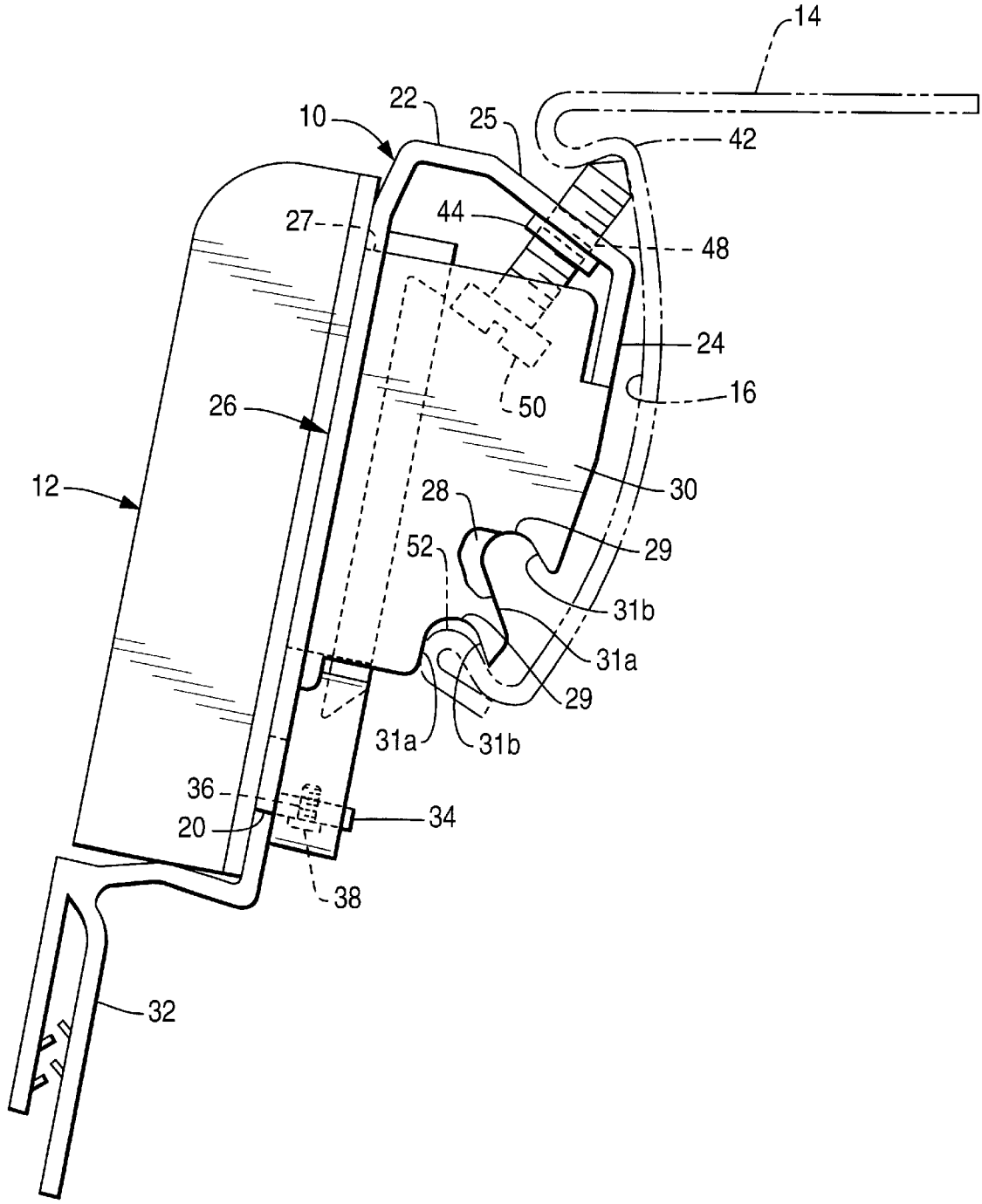
FIG. 1 is a side view of the EPL mounting apparatus.
Figure 2:
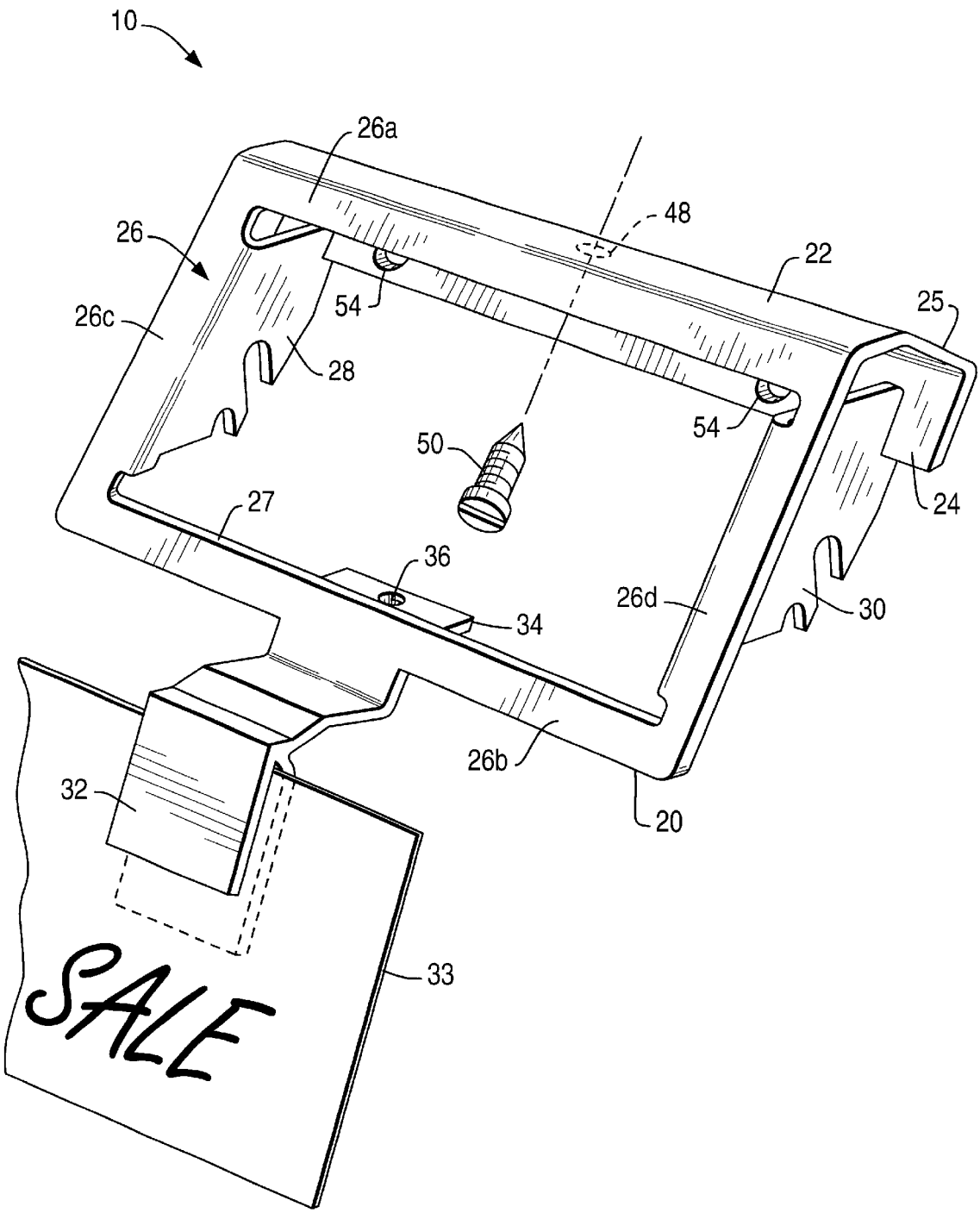
FIG. 2 is a front perspective view of the EPL mounting apparatus.
Figure 3:
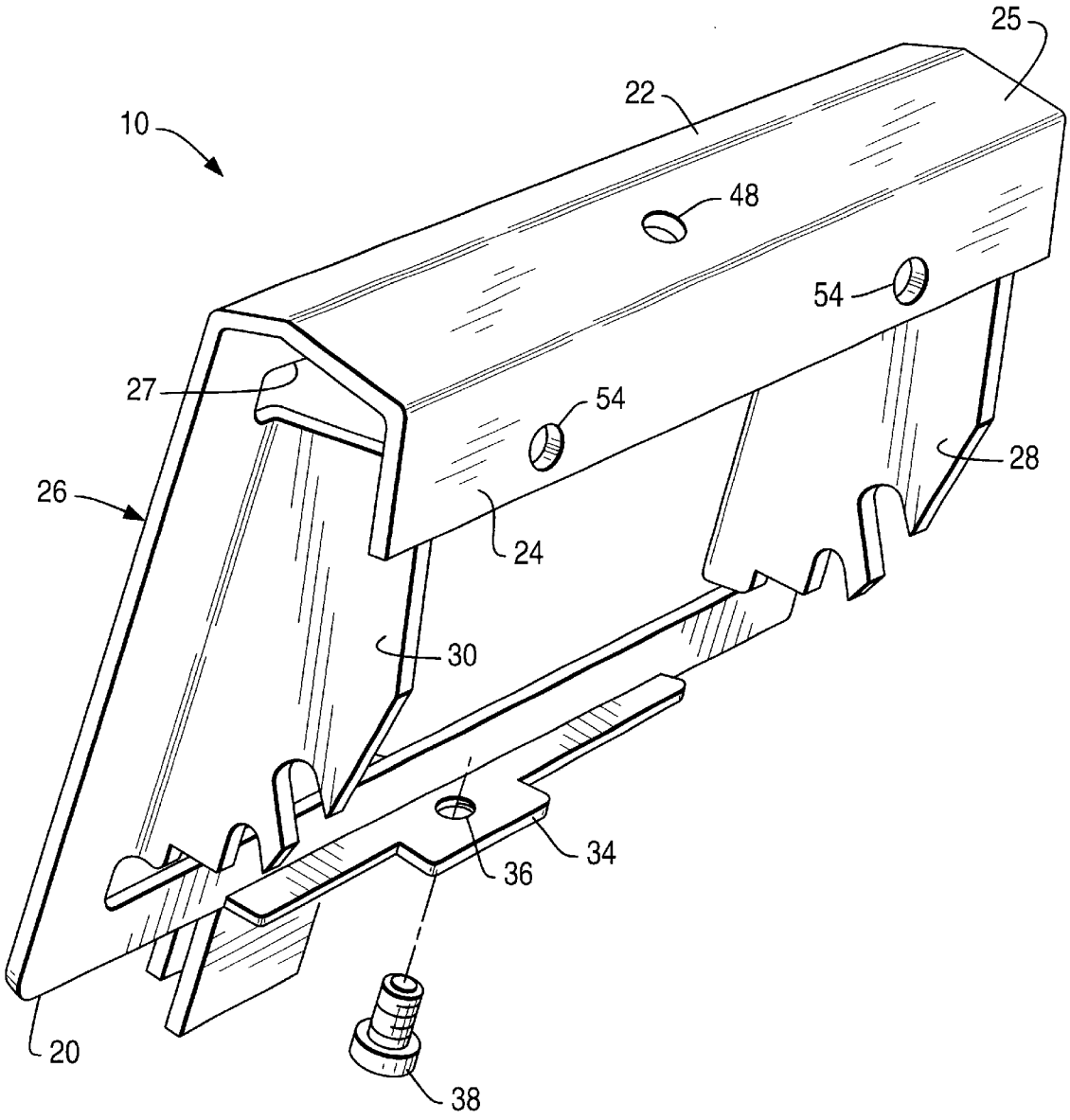
FIG. 3 is a rear perspective view of the EPL mounting apparatus.

Referring now to FIGS. 1–3, EPL mounting apparatus 10 primarily includes frame portion 20, and top portion 22.

Frame portion 20 includes front wall portion 26, left and right wall portions 28 and 30, bib retaining portion 32, and flange 34.

Front wall portion 26 retains EPL 12 through aperture 27. Front wall portion 26 includes top portion 26*a*, bottom portion 26*b*, and side portions 26*c* and 26*d*.

Left and right wall portions 28 and 30 provide rigidity, support mounting apparatus 10 in lower shelf lip 52, and secure mounting apparatus 10 to lower shelf lip 52. For this purpose, left and right wall portions 28 and 30 are oriented at substantially perpendicular angles between front wall portion 26 and back wall 24 of top portion 22. Left and right wall portions 28 and 30 thereby resist inward movement of front wall portion 26. Left and right wall portions 28 and 30 also resist downward compression of top portion 22 for defeating locking screw 50 by supporting adjoining back wall 24 of top portion 22.

Left and right wall portions 28 and 30 include indent portions 29 which roughly correspond in shape to the shape of lower shelf lip 52. Two indent portions 29 may be included to accommodate mounting in different sizes of shelf C-channels 16. Left sides 31*a* of indent portions 29 establish an inward travel limit for EPL mounting apparatus 10 and right sides 31*b* establish an outward travel limit. Together left and right sides 31*a* and 31*b* snugly retain left and right wall portions 28 and 30 to lower shelf lip 52 when screw 50 is tightened.

Bib retaining portion 32 retains bib 33, which contains special information about a product, such as special promotion or "sale" information. The presence of a bib distinguishes the product from other products.

Bib retaining portion 32 extends from front wall portion 26 in order to place a bib, when installed, in a position which is substantially coplanar with the front surface of EPL 12. Alternatively, bib retaining portion 32 may be absent. If so, bib 33 may be inserted between front wall 26 and EPL 12.

Flange 34 includes threaded aperture 36 through which screw 38 extends into EPL 12. Tightening of screw 38 secures EPL 12 within EPL mounting apparatus 10.

Top portion 22 extends from frame portion 20 into shelf C-channel 16. Top portion 22 establishes an inward travel limit for EPL mounting apparatus 10.

Top portion 22 also supports locking screw 50 which helps to retain EPL mounting apparatus 10 in shelf C-channel 16. Top portion 22 includes threaded aperture 48 in an inclined portion 25 through which screw 50 extends towards upper portion 42 of C-channel 16. Top portion may additionally include additional material 44 extending from aperture 48 to reinforce the strength of top portion 22 in that area. Tightening of screw 50 secures mounting apparatus 10 to C-channel 16. Screwdriver access to screw 50 for installing and removing screw 50 is through aperture 27. Screw 50 allows mounting apparatus 10 to be securely mounted in C-channels of different heights within a predetermined range of heights.

The illustrated embodiment places EPL 12 in a generally upwardly facing position, suitable for mid to lower shelves 14. However, top portion 22 and left and right wall portions 28 and 30 may have different shapes for facilitating more upward or even downward viewing angles.

Additionally, EPL mounting apparatus 10 is versatile enough to be used in connection with other mounting surface besides C-channel 16. Back portion 24 may include apertures 54 through which screws may be applied for fastening EPL mounting apparatus 10 to a sign, wall surface, or other structure. Thus, EPL mounting apparatus 10 is suitable for promoting special, "on sale", or heavily promoted items at locations such as end aisle displays and checkout shelves.

EPL mounting apparatus 10 is preferably die-cut from steel sheet metal for strength and then bent to shape. Mounting apparatus 10 is rigid enough to prevent bending and removal of mounting apparatus 10 without tools.

Attachment of mounting apparatus 10 to shelf 14 is straightforward. With EPL 12 removed and screw 50 loosened, Indent portion 29 is placed against lower shelf lip 52 of C-channel 16. EPL mounting apparatus 10 is then rotated inwardly towards shelf 14. Screw 50 is tightened against upper portion 42 of C-channel 16. EPL 12 is then inserted and secured in a manner discussed below.

Removal of mounting apparatus 10 proceeds in an opposite fashion.

Figure 4:
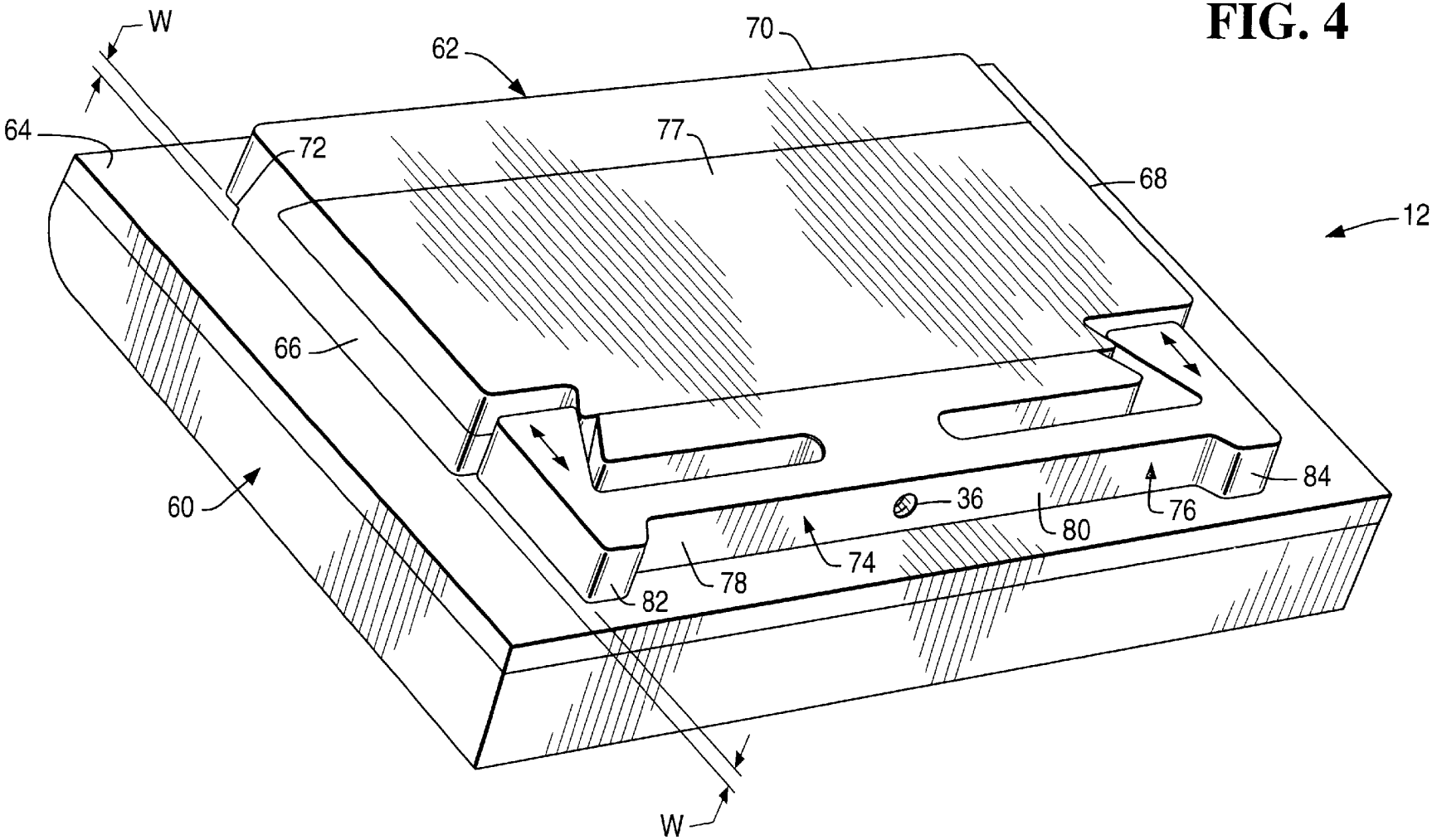
FIG. 4 is a rear perspective view of an EPL which uses the mounting apparatus.

Referring now to FIG. 4, EPL 12 is shown in more detail, particularly portions which serve to secure EPL 12 within mounting apparatus 10.

EPL 12 includes main portion 60 and battery storage portion 62.

Main portion 60 contains a liquid crystal display and a printed circuit board containing control circuitry. Main portion 60 also includes rear surface 64 which abuts front wall portion 26 when EPL 12 is installed within mounting apparatus 10.

Battery storage portion 62 fits within aperture 27 of front wall portion 26. For this purpose, battery storage portion 62 has a shape which substantially coincides with the shape of aperture 27, except that the height of battery storage portion 62 is larger than the height of aperture 27 in order to secure EPL 12 in place within aperture 27. Side edges 66 and 68 pass along side portions 26*c* and 26*d* of frame portion 20 when EPL 12 is inserted.

Battery storage portion 62 includes channel 72 adjacent top edge 70 and rear surface 64. Channel 72 has a width W substantially equal to the width of front wall portion 26. Top portion 26*a* of frame portion 20 is located within channel 72 when EPL 12 is inserted.

Battery storage portion 62 further includes left and right retainers 74 and 76 which keep battery storage door 77 closed and which also retain EPL 12 within mounting apparatus 10.

Left and right retainers 74 and 76 include spring members 78 and 80 and latches 82 and 84.

Latches 82 and 84 retain battery storage portion 62 behind bottom portion 26*b* of frame portion 20.

Spring members 78 and 80 connect to a common center at the bottom of battery storage portion 62. Spring members 78 and 80 normally bias latches 82 and 84 to a position behind bottom portion 26*b* of frame portion 20.

Attachment of EPL 12 to mounting apparatus 10 is straightforward. With mounting apparatus 10 installed in shelf C-channel 16, top edge 70 of battery storage portion 62 is inserted through aperture 27 with top portion 26*a* in channel 72. EPL 12 is then rotated towards aperture 27. Left and right retainers 74 and 76 are temporarily biased in an upwards direction to allow latches 82 and 84 to clear bottom portion 26*b* of frame portion 20. Left and right retainers 74 and 76 are then released to allow latches 82 and 84 to fall behind bottom portion 26*b* of frame portion 20. Screw 38 is then inserted into aperture 36 through flange 34 to complete the installation.

Removal of EPL 12 proceeds in an opposite fashion.

Advantageously, the EPL retaining features of the prevention invention minimize the chance of accidental or unauthorized removal of both EPL 12 and mounting apparatus 10.

Although the present invention has been described with particular reference to certain preferred embodiments thereof, variations and modifications of the present invention can be effected within the spirit and scope of the following claims. Mounting apparatus 10 may be made to different widths to accommodate mounting EPLs of different widths. Mounting apparatus 10 may also be formed to orient EPL 12 at other angles than those illustrated.

We claim:

1. An electronic price label mounting apparatus comprising:

a generally planar frame member defining an aperture having four sides for surrounding an electronic price label;

wherein the frame member includes:

a flange extending from a wall of the frame member and having an aperture through which a fastener extends, wherein the fastener retains the electronic price label in the frame member when the electronic price label is inserted into the frame member;

a top member extending from the frame member; and a fastener for securing the top member to a mounting surface.

2. The electronic price label mounting apparatus as recited in claim 1, wherein the top member includes an inclined portion having an aperture, and wherein the fastener extends through the aperture for applying pressure to a corner of a C-channel when the electronic price label mounting apparatus is inserted into the C-channel.

3. The electronic price label mounting apparatus as recited in claim 1, wherein the top member includes a back portion having an aperture, and wherein the fastener extends through the aperture for applying pressure to the mounting surface.

4. The electronic price label mounting apparatus as recited in claim 1, further comprising a number of wall portions extending between the top member and the frame member; wherein the wall portions include an indent portion which helps to secure the wall portions to a C-channel.

5. The electronic price label mounting apparatus as recited in claim 1, further comprising:

a bib holder extending from the frame member.

6. An electronic price label mounting apparatus comprising:

a generally planar frame member defining an aperture having four sides for surrounding an electronic price label and including a flange extending from a wall of the frame member and having a second aperture;

a first fastener for retaining the electronic price label in the frame member;

a top member extending from the frame member including an inclined portion having a third aperture;

a second fastener which extends through the third aperture to secure the top member in a C-channel; and a number of wall portions extending between the top member and the frame member including an indent portion which helps to secure the wall portions to the C-channel.

7. The electronic price label mounting apparatus as recited in claim 6, wherein the top member includes a back portion having a fourth aperture for mounting the electronic price label to a mounting surface instead of the C-channel.

8. The electronic price label mounting apparatus as recited in claim 6, further comprising:

a bib holder extending from the frame member.

9. A method of mounting an electronic price label to a C-channel comprising the steps of:

placing an indent portion of a wall extending from a frame member over a lip of the C-channel;

securing a rear extension of the frame member to a corner of the C-channel opposite the lip, including tightening a first fastener extending through a threaded aperture of the rear extension against the corner; and securing the electronic price label to the frame member including tightening a second fastener extending through an aperture in a flange of the frame member and into the electronic price label.

10. An electronic price label mounting apparatus comprising:

a frame member defining an aperture for surrounding an electronic price label and including a flange extending from a wall of the frame member and having a second aperture;

a first fastener for retaining the electronic price label in the frame member;

a top member extending from the frame member and including an inclined portion having a third aperture, and a back portion having a fourth aperture for mounting the electronic price label to a mounting surface rather than a C-channel;

a second fastener which extends through the third aperture to secure the top member to the C-channel; and a number of wall portions extending between the top member and the frame member and including an indent portion which helps to secure the wall portions to the C-channel.

11. An electronic price label mounting apparatus comprising:

a generally planar frame member defining an aperture having four sides for surrounding an electronic price label;

a top member extending from the frame member;

a number of planar wall portions extending at substantially right angles from the frame member side;

wherein the wall portions include an indent portion which helps to secure the wall portions to a C-channel; and a fastener for securing the top member to a mounting surface.

* * * * *